US005245810A

United States Patent [19]

Foss

[11] Patent Number: 5,245,810

[45] Date of Patent: Sep. 21, 1993

[54] BUILDING ELEMENT

[76] Inventor: Stein R. Foss, Viksjoen Vikanvegen, 7500 Stjordal, Norway

[21] Appl. No.: 735,858

[22] Filed: Jul. 25, 1991

[30] Foreign Application Priority Data

Feb. 10, 1989 [NO] Norway ..... 890569

[51] Int. Cl.[5] ..... E04B 2/14

[52] U.S. Cl. ..... 52/405; 52/612; 264/DIG. 57

[58] Field of Search ..... 52/575, 576, 309.12, 52/405, 612; 264/DIG. 57, 42, 71, DIG. 39, DIG. 43, 177.11; 425/131.1, 133.1

[56] References Cited

U.S. PATENT DOCUMENTS

| | | | |
|---|---|---|---|
| 1,409,329 | 3/1922 | Yamanouchi | 52/605 |
| 1,524,147 | 1/1928 | Murray | 52/576 |
| 2,087,541 | 7/1937 | Koester | 52/405 |
| 4,186,536 | 2/1980 | Piazza | 52/309.12 |

FOREIGN PATENT DOCUMENTS

| | | | |
|---|---|---|---|
| 360724 | 1/1981 | Austria . | |
| 1065201 | 1/1954 | France | 52/577 |
| 12350 | 5/1900 | Sweden . | |
| 40932 | 6/1915 | Sweden . | |
| 227752 | 9/1943 | Sweden . | |
| 131945 | 6/1951 | Sweden . | |
| 415845 | 11/1980 | Sweden . | |

*Primary Examiner*—James L. Ridgill, Jr.
*Attorney, Agent, or Firm*—James E. Pittenger

[57] ABSTRACT

A building element for masonry walls, particularly load-carrying walls in the foundation walls of dwellings and industrial premises and in outer walls, such as in outbuilding, the element comprises a core of insulating materials, surrounded by side members that are respectively the inner and outer side of the finished wall. Massive end members are cast in connection with the side members. Side members are made completely with concrete or of other strong materials which can easily withstand vertical and lateral loads. The end members are made of lightweight concrete or similar materials. The end members are located to connect the inner and outer walls and at the same time provide good insulation characteristics.

14 Claims, 2 Drawing Sheets

BUILDING ELEMENT

Figure 1:
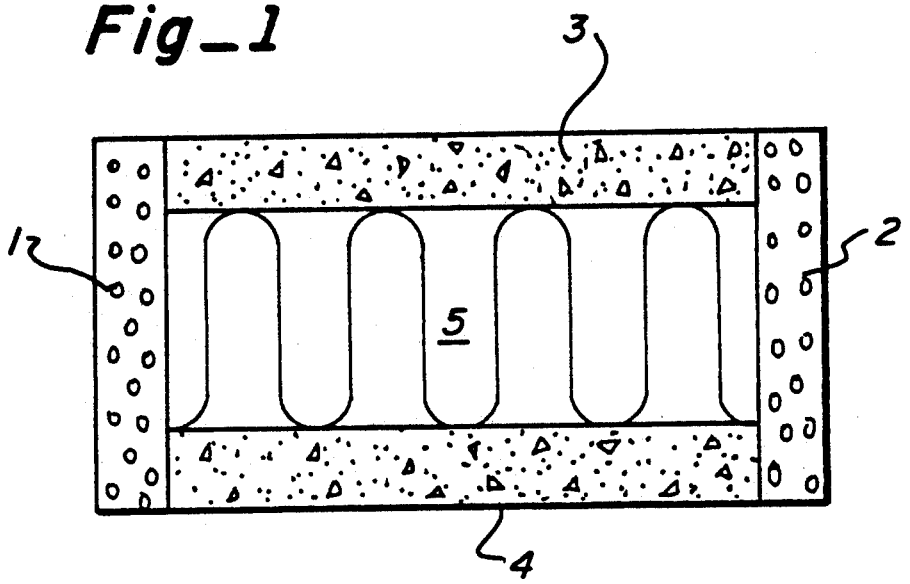

This is a continuation of International application PCT/N090/00029, filed on Feb. 5, 1990, which designated the United States, and was co-pending with this application and is now abandoned.

The invention concerns a building element which can be used in the construction of masonry walls in detached and terraced houses, as outer walls in agricultural outbuildings, and also in industrial and business premises, where among other things it functions as the primary load-carrying system for low buildings.

Concrete building blocks or elements with insulation are known in the prior art. They include strong materials which at the same time provide insulation. These types of building elements are often called insulation blocks.

German patent, DE 2 756 820, and Austrian patent, AT 360 724, describe concrete elements with a core of an insulating material. They will provide satisfactory insulation in the cross section of the wall that is insulated. However, a thermal bridge will be formed at the end walls in the blocks, which will reduce the overall insulation ability considerably. The same will occur with the concrete construction shown in Swedish patent, SE 40 932, which is also not based on prefabricated elements.

Swedish patent, SE 131 945, describes a building element with a core of an insulating material, where the end walls are shortened so that there will be a cavity in the finished wall. This partly solves the thermal bridge problem, but greatly reduces the mechanical strength.

A particular objective with the present invention is to produce a building element that constructs masonry/-walls that can withstand relatively large vertical and lateral loads, good heat insulation, and which is particularly suited for applications such as fire walls and other walls where fire resistance is important.

Another objective is that the building element is to be made so that it is not too difficult to drill holes through it for electric cable, pipes and water pipes. The elements are relatively easy to handle and provide good attachment for the fittings and accessories that are normal for brick walls.

A favorable combination of elements of recognized well tried materials has resulted in an insulation block with relatively high vertical and lateral loadcarrying ability. This is the result of using side members of high strength concrete and end members or walls of lightweight concrete with relatively good mechanical characteristics. The end members with these characteristics act as strong bonds or ties, and with their relatively close location in the finished wall this means that they connect the two side members in a very efficient manner.

Another feature is that the insulation block in the present invention contains mineral wool, which is an insulation material with extremely-good heat insulation properties that is noncombustible and flame resistant; the nonflammable feature is a great advantage over other known insulation blocks that contain foamed plastics.

The present invention also has designed a building element that is constructed for the easy drilling of holes for electric cable pipes and water pipes since such holes can be made through the end members of lightweight concrete in the joints between elements.

Even though the insulation block has concrete side members, which have relatively high specific weight in relation to lightweight concrete, they will nevertheless be easy to handle. This is because the side member can be relatively thin due to the bonding effect of the end members in the finished wall, and the high compressive strength of concrete in the side members. This means that the weight can be kept low and the final weight of the block makes it easy to handle.

With 5 cm thick side members and end members and 15 cm of mineral wool insulation, the insulation block according to the present invention should have a k-value of about 0.3, measured with the normal units.

Figure 2:
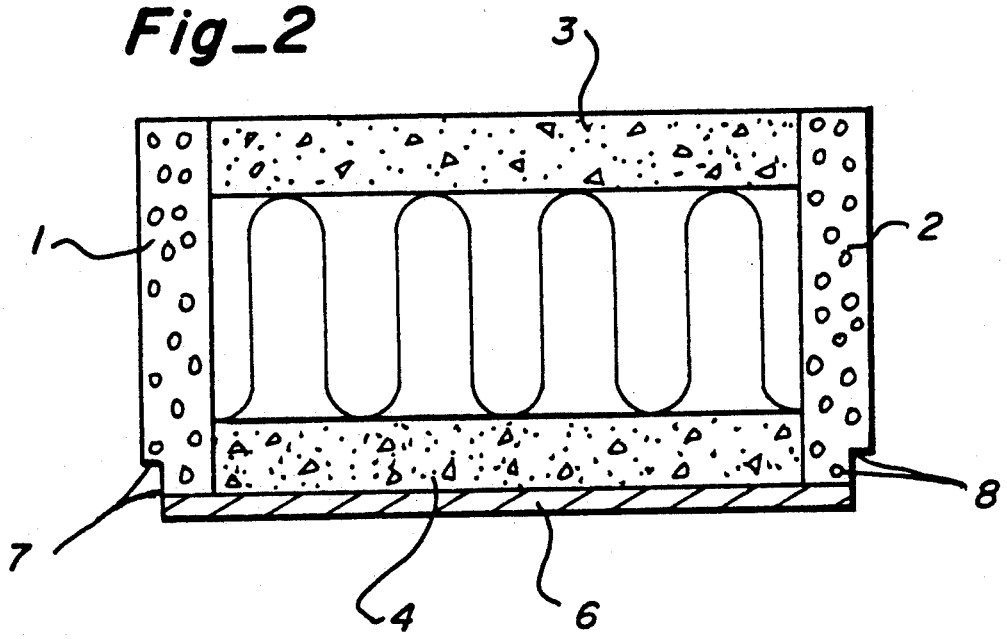
Figure 3:
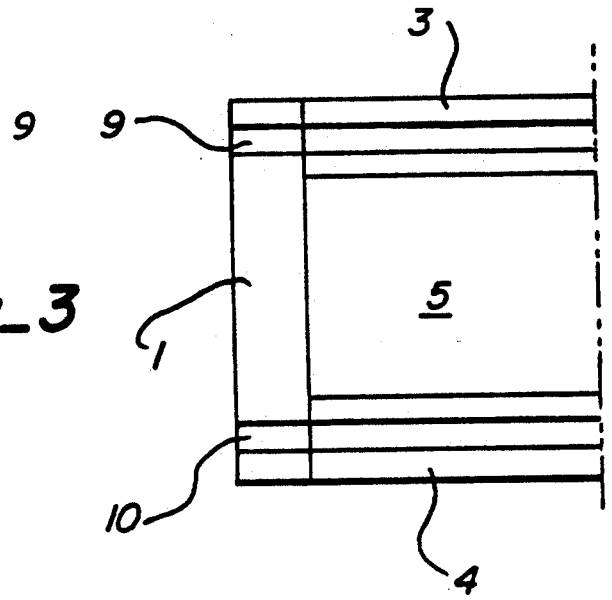
Figure 4:
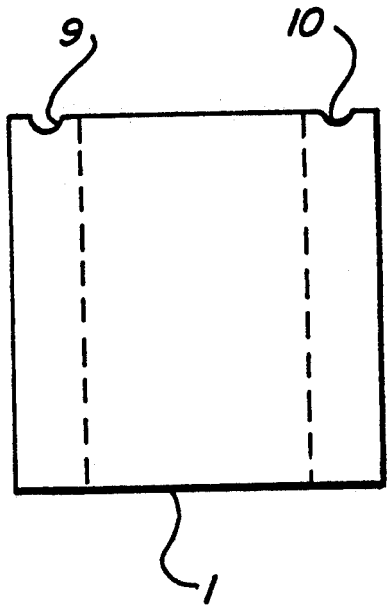

The following describes the invention in more detail with reference to the accompanying drawings, where FIG. 1 shows a building element in accordance with the present invention in horizontal cross-section, FIG. 2 shows a horizontal cross-sectional design of a building element in accordance with the present invention having a facing, FIG. 3 shows a top perspective of a symmetrical half of the design in FIG. 1, and FIG. 4 shows a lateral perspective of the design in FIG. 1.

A building element or insulation block is shown in FIG. 1, this has massive end walls or members 1, 2 of lightweight concrete with pumice or clinker as aggregate. Between the end walls there are side members 3, 4 of massive concrete, i.e. normal concrete, with finely-grained sand as aggregate. There is an insulation core, or insulation unit 5 made of mineral wool in the cavity inside the block. The side members 3, 4 and the end members 1, 2 are cast together so that the end walls 1, 2 act as an effective bond or tie between the inner and outer sides of the finished wall components.

The end walls 1, 2 of lightweight concrete can have precast reinforcement that apart from reinforcing the wall can also strengthen the connections to the side members. This reinforcement is not, however, necessary partly because the end walls may be relatively thick and partly because the contact surface between the end members and the side members should be sufficiently large to provide a strong connection between them. Such reinforcement could also be an obstacle for the drilling of holes for electric cable, pipes or water pipes.

As mentioned, the insulation block according to the present invention will meet numerous functions, requirements or stipulations. Irrespective of whether the block is used in areas of walls between supports and floor dividers or used as the primary load-carrying system in a building, it can, as shown in FIG. 2, have a surface treatment 6 on the facing side 4 combined with grooved recesses 7, 8 on the facing edges of end members 1, 2. The grooved recesses 7, 8 are particularly designed to provide an undersurface for the mortar in the connecting joints between two adjoining blocks. The surface treatment on the facing side 4 can be of the same material as the end members 1, 2 or the side members 3, 4.

Because of the reduction in the thickness of the side member that is permitted by the end members acting as an effective bond or tie, the joint reinforcement can be of steel rods. The blocks can have longitudinal tracks or grooves 9, 10 so that steel reinforcement rods can be laid in the grooves before the joining mortar is added, this will make the use of such reinforcement easier. The most favorable cross section for such grooves should have a dish-like or semicircular profile, as shown in FIG. 4 with a width that is slightly larger than the diameter of the steel rods. The joining mortar should then easily surround the steel reinforcement rods.

As the thickness of the side members can be relatively thin because of the rigidity of the end members through their bonding and tying effect, the insulation unit 5 of mineral wool, can be made relatively thick so that the block has a low k-value and good resistance to the conduction of or high temperatures heat in case of fire.

The lightweight concrete in the end members can be of porous concrete instead of the type that has an aggregate material, such as clay clinker. The main point is that lightweight concrete combines satisfactory mechanical characteristics with good heat insulation properties so that the insulation blocks can be efficient without allowing a thermal bridge to form between the two side elements in the finished wall.

I claim:

1. A building element for masonry facing walls having large load-carrying and insulating capabilities, which building element comprises a core of insulating materials, surrounded by side members which form respectively inner and outer facing of the erected wall; and members characterized by a. the end members being made in insulating lightweight concrete and extending substantially the entire width of the building element, which end members are rigidly connected to the side members by bonding means whereby the end members provide insulation and are easily penetrable to form openings for electrical cables, pipes, water pipes etc.;

b. the core consisting substantially of mineral wool, and said core is together with the end members arranged to form respectively a well insulated and fire-safe building element; and c. the side members being made of concrete or of other strong material and being arranged inbetween the end members to reduce the overall weight of the building element; additionally, the side members and end members having substantially the same thickness, whereby the building element will have sufficient strength by the double thickness of two adjacent end members.

2. A building element according to claim 1, characterized by further comprising a combination of vertically arranged recesses in the corners of the end members towards the facing wall, and a surface treatment covering the side surface of the building element between the recesses.

3. A building element for masonry walls, particularly load-carrying walls in the foundation walls of dwellings and industrial premises and in other walls, such as in outbuildings, said building elements having a thickness corresponding to the thickness of the wall, the building element comprises a core of insulating materials, surrounded by side members that are respectively an inner and outer side of a finished wall, and end members cast in connection with the side members, where the side members are made from a strong material which can easily withstand vertical and lateral loads, characterized by the end members each having a length which corresponds to the thickness of the element and has opposite sides and ends and is made from light weight concrete so as to form insulating connections between the inner and outer sides of the finished wall.

4. A building element as claimed in claim 3, characterized in that the side members abut with the sides of the end members and are attached to the end members by suitable bonding means to form a permanent bond between the members.

5. A building element as claimed in claim 4, characterized in that in the corners towards the facing wall there are vertical recesses.

6. A building element as claimed in claim 4, characterized by the end members having precast reinforcement.

7. A building element as claimed in claim 4, characterized by the core consisting of mineral wool.

8. A building element as claimed in claim 4, characterized by the end members consisting of porous concrete.

9. A building element as claimed in claim 4 characterized in that a surface treatment is applied to one or both of the side members and the corresponding ends of the end members so that an improved finish is provided on the corresponding side of the finished wall.

10. A building element as claimed in claim 4, characterized in that the side members have top and bottom surfaces and longitudinal grooves are formed in one or both of these surfaces to receive a joint reinforcement, and the adjoining part of the end members include longitudinal grooves for the location of a joint reinforcement means.

11. A building element as claimed in claim 10, characterized in that the grooves have a semiconductor cross section.

12. A building element as claimed in claim 4 characterized by the end members consisting of lightweight concrete with aggregate materials.

13. A building element as claimed in claim 12, characterized by the aggregate material being pumice.

14. A building element as claimed in claim 12, characterized by the aggregate material being clinker.

* * * * *